United States Patent [19]

Babiol

[11] 4,311,259

[45] Jan. 19, 1982

[54] RETRACTABLE POURER ASSEMBLIES

[75] Inventor: Pierre Babiol, Villefranche sur Saone, France

[73] Assignee: Societe Nouvelle de Bouchons Plastiques, Anse, France

[21] Appl. No.: 145,287

[22] Filed: Apr. 30, 1980

[51] Int. Cl.[3] ..... B65D 25/44

[52] U.S. Cl. ..... 222/525; 220/285; 222/538

[58] Field of Search ..... 222/522–525, 222/527–530, 538; 215/304; 220/285

[56] References Cited

U.S. PATENT DOCUMENTS

| | | | |
|---|---|---|---|
| 979,226 | 12/1910 | Thompson | 220/285 |
| 1,383,265 | 6/1921 | Birkenbeuel | 220/285 |
| 2,851,202 | 9/1958 | Bradbury | 222/522 X |
| 4,076,151 | 2/1978 | Littlefield | 222/525 |
| 4,236,629 | 12/1980 | Dwinell | 222/530 X |

FOREIGN PATENT DOCUMENTS

| | | | |
|---|---|---|---|
| 224928 | 2/1958 | Australia | 222/525 |

*Primary Examiner*—F. J. Bartuska
*Attorney, Agent, or Firm*—Dowell & Dowell

[57] ABSTRACT

In a retractable pourer assembly associated with a receptacle, of the type comprising an annular base clipped in the opening of the receptacle, a tubular pourer sliding with respect to the base which bears a bead for limiting its outward stroke while its lower part is provided with a bead cooperating with the base in its emerged position, a stopper presenting a thread adapted to be screwed on the free end of the pourer and which is provided with a second skirt surrounding the one bearing the thread, said second skirt being provided with two diametrically opposite rings clipping beneath the bead on the base, and two half-rings associated with the periphery of said second skirt, each ring being connected to the periphery of the second skirt of the stopper on the one hand by at least one bridge and on the other hand by two parallel, opposite lugs constituting pivots and beyond which the two ends of the half-ring project to form disengagement lever.

4 Claims, 6 Drawing Figures

RETRACTABLE POURER ASSEMBLIES

The present invention relates to improvements in retractable pourer assemblies used in particular, but not exclusively, on cans so as to facilitate flow of their contents without being detrimental to the possibility of stacking thereof.

When the pourers in question are associated with a metal can such as a can of oil for vehicles, they generally comprise three elements: a base clipped in an opening in the top of the receptacle, a tubular spout adapted to slide hermetically with respect to the base in order to project with respect to the receptacle against a suitable stop, and a stopper associated with the free end of the pourer.

The improvements according to the present invention aim at enabling a pourer of the type in question to be produced, which reponds better than heretofore to the various requirements of the art.

To this end, the stopper comprises a second outer skirt whose inner face is provided with two separate rings located opposite each other and which clip beneath a bead on the base, whilst the outer face of said skirt is associated with two half-rings each constituting a lever adapted to facilitate raising of the stopper with respect to said bead on the base.

The invention will be more readily understood on reading the following description with reference to the accompanying drawings, in which.

Figure 1:
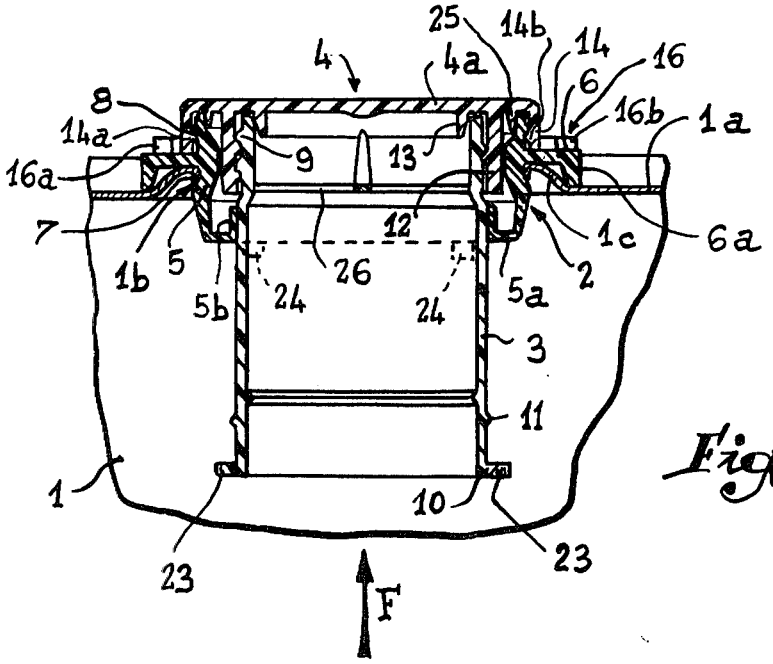
FIG. 1 is a view in section of a pourer assembly according to the invention, shown in retracted position with respect to the top of a receptacle.

Referring now to the drawings, FIG. 1 shows a retractable pourer assembly according to the invention associated with the top 1*a* of a receptacle 1 in the form of a metal can. This pourer is more particularly disposed in an opening 1*b* made at the centre of a boss 1*c* in the said top.

The pourer assembly comprises a base 2, a tubular spout 3 and a stopper 4 closing the latter, these three elements being made of a suitable plastics material, as will be explained hereinafter.

The base 2 which is made of a material such as polyethylene comprises a central sleeve 5 extended radially by a flange 6 which comprises a downwardly bent end 6*a*, a groove 7 being formed immediately beneath the lower face of this flange. The bottom of the sleeve 5 is provided with an edge 5*a* bent twice at 90° so as to constitute a thin central shaft 5*b* adapted to cooperate hermetically with the periphery of the tubular spout 3. The part of the sleeve 5 located above the flange 6 is provided with a peripheral bead 8.

Figure 2:
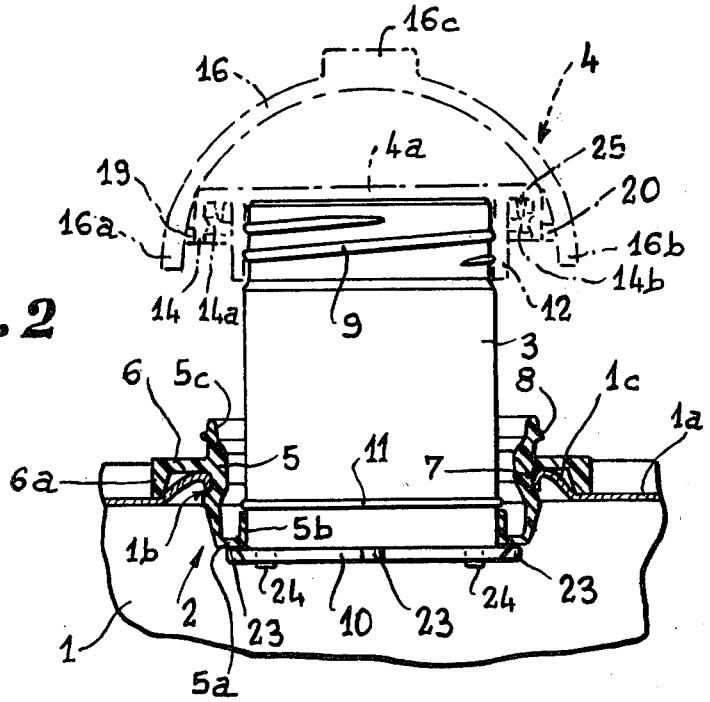
FIG. 2 is a view similar to that of FIG. 1, but illustrating the pourer in its emerged position.

As shown in FIG. 2, the base 2 is elastically clipped inside the opening 1*b* made in the boss 1*c* in the top 1*a* of the receptacle 1.

The tubular spout 3 which is also made of polyethylene comprises in its upper part a thread 9 whilst its base is surrounded by a peripheral flange 10. The periphery of the spout 3 is provided with a bead 11 of which the distance to the flange 10 is, apart from the clearance, equal to the height of the shaft 5*b*.

Figure 3:
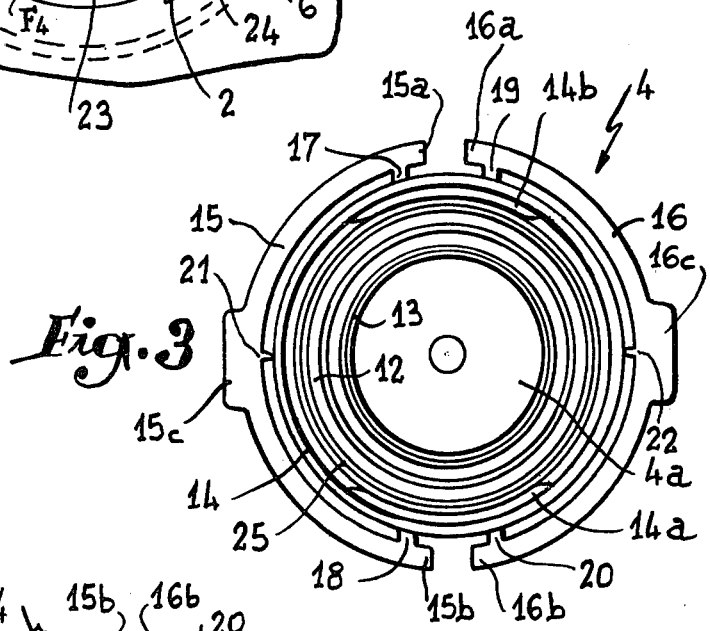
FIG. 3 shows the stopper for closing the spout, seen from underneath.

The stopper 4 which is preferably made of polypropylene is provided with a skirt 12 whose inner face is threaded, its bottom end 4*a*, which comprises an annular lip 13 disposed more to the centre than the skirt 12, extending beyond the latter to bear a second skirt 14 coaxial to the first and whose inner face is provided with two diametrically opposite rings 14*a*, 14*b* (FIG.3) extending over about one quarter of the circumference of the face in question. The second skirt 14 is surrounded by two half-rings 15, 16 whose length is smaller than its half-circumference. Each ring is rendered fast with the latter via two lugs 17, 18, 19, 20 located in two's opposite one another and beyond each of which each half-ring projects to form a foot 15*a*, 15*b* and 16*a*, 16*b* respectively. Each half-ring further comprises a central ear 15*c*, 16*c* facilitating grip, as will be better explained hereinafter. Finally, the periphery of the skirt 14 is connected to the centre of each ring by a bridge 21, 22.

Figure 4:
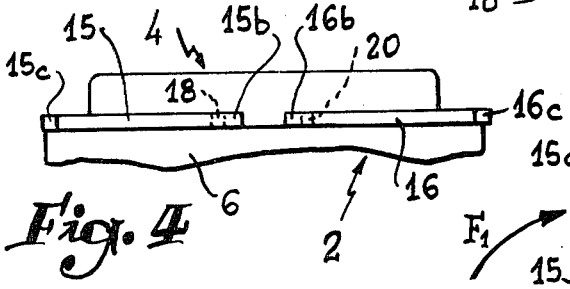
FIG. 4 is a partial outer view of the device according to the invention.
Figure 5:
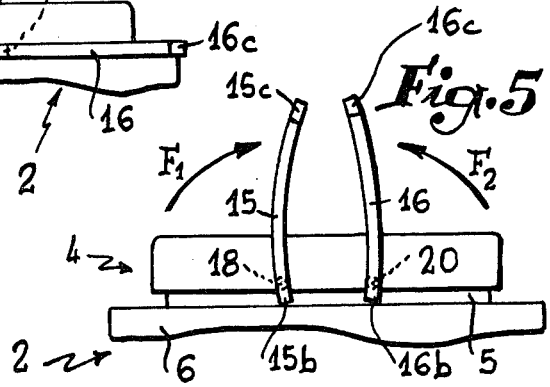
FIG. 5 illustrates the manner in which the stopper is disengaged from the base.

The pourer is assembled with respect to the receptacle 1 by firstly engaging the spout 3 in the base 2 by its end bearing the thread 9, this operation being effected from underneath with respect to the channel 5*b*. The stopper 4 is then completely screwed onto the thread 9. Finally, the spout is retracted so that the stopper is positioned as shown in FIG. 1 with respect to the base 2. At this stage, this is a foolproof stopper (FIG. 4) whose half-rings 15, 16 rest against the top of the flange 6. For first use, the user grips the two ears 15*c*, 16*c* and acts thereon to pivot the half-rings in the direction of arrows F1, F2 (FIG. 5) about the bridges 21, 22, this firstly causing the latter to break then causing the end of the feet 15*a*, 15*b*, 16*a*, 16*b* to pivot downwardly into contact with the top of the flange 6. Due to the quality of the material constituting the stopper and the dimensions of the lugs 17, 18, 19, 20, the raising of the rings beyond their position corresponding to the contact of the feet with the top of the flange 6 causes the disengagement of the stopper with respect to the rings 14*a*, 14*b* by lever effect so that the stopper is disengaged from the base 2. If the user pulls the two half-rings even more in upward direction, he causes the spout 3 to emerge until its flange 10 comes into contact with the the lower bent edge 5*a* of said base (FIG.2). At this moment, the the spout is axially locked between the bead 11 and the flange 10. As the latter comprises outwardly oriented radial projections 23 (FIG.6), the rotation of the stopper still screwed onto the spout 3 brings these projections against stops 24 provided beneath the lower edge of the base (arrow F3), and the stopper may easily be unscrewed since the spout 3 becomes nonrotatable.

After the contents of the receptacle have been poured out and when the stopper 4 is rescrewed on the spout 3, the latter rotates in the direction of arrow F4 so that the projections leave the stops on which they abut to come against the adjacent ones. The stopper may therefore be completely screwed onto the spout. To retract the spout, it suffices to press downwardly on the stopper: the shaft 5*b* deforms slightly on passage of the bead 11, and finally the rings 14*a*, 14*b* clip beneath the bead 8 of the base. It will be noted that four projections 23 and four stops 24 are advantageously provided.

The bottom end of the stopper is noted to be provided with a second lip 25 (FIG.2) which cooperates with the inner periphery of the opening 5*c* with a view to ensuring tightness when the stopper is replaced, both respect to inside the base and outside.

Figure 6:
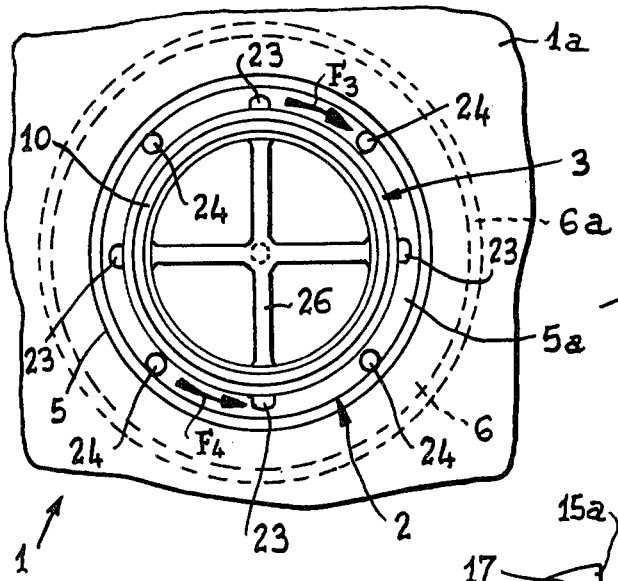
FIG. 6 is a view from underneath of the spout according to the invention in the direction of arrow F (FIG. 1).

In FIG. 6, the presence is noted of a crosspiece 26 inside the spout 3, its centre being intended to receive the point of injection of the element in question.

The preceding description has been given simply by way of non-limiting example and the replacement of the details of execution described by any other equivalents will not depart from the scope of the invention.

What is claimed is:

1. A retractable pourer assembly to be mounted in an opening in a receptacle, comprising:

(a) an annular based shaped to be entered into and clipped in said opening, and having a hollow sleeve extending therethrough and supporting a flange overlying the periphery of the opening in the receptacle;

(b) a tubular pourer slidabley extending through said sleeve, the pourer having annular means to limit movement of the pourer along the sleeve, and having screw threads at its outer end;

(c) a stopper having threaded skirt means operative to screw onto the threads of the pourer to close the outer end thereof, and the stopper having means yieldably retaining the stopper fixed to the base when the pourer is retracted in the base, and the stopper having pairs of lugs extending outwardly therefrom over said flange and having two half-rings supported by different pairs of the lugs and overlying the flange, each half-ring having opposite ends extending beyond the lugs and constituting feet overlying the flange, whereby when the half-rings are pivoted upwardly about the lugs away from the flange their feet will lever downwardly against the flange and disengage said means yieldably retaining the stopper fixed to the base.

2. The pourer assembly as claimed in claim 1, wherein said means yieldably retaining the stopper fixed to the base comprises opposed interfering bead means respectively carried by the stopper and by the sleeve of the base and engaged when the stopper is pressed onto the base.

3. The pourer assembly as claimed in claim 1, wherein the sleeve of the base has a radially inwardly extending end supporting a tubular shaft surrounding the pourer and sealing thereagainst, and the pourer having annular enlargements spaced apart by the length of the shaft and retaining the pourer in an extended position with respect to the base, the inwardly extending end being made of thin material to faciliate flexing thereof to conform with the position of the pourer in the shaft.

4. The pourer assembly as claimed in claim 3, wherein the pourer and the inwardly extending end have mutually engaging stop means to prevent rotation of the pourer with respect to the base when in extended position.

* * * * *